US006453813B1

(12) United States Patent
Faber

(10) Patent No.: US 6,453,813 B1
(45) Date of Patent: Sep. 24, 2002

(54) AXIAL LOCKING DEVICE FOR THE SWIVELING AXLE OF A HAND-HELD STAMP AND HAND-HELD STAMP

(75) Inventor: Ernst Faber, Wels (AT)

(73) Assignee: Colop Stempelerzeugung Skopek GmbH & Co. KG, Wels (AT)

( * ) Notice: Subject to any disclaimer, the term of this patent is extended or adjusted under 35 U.S.C. 154(b) by 0 days.

(21) Appl. No.: 09/807,550

(22) PCT Filed: Sep. 21, 1999

(86) PCT No.: PCT/AT99/00228

§ 371 (c)(1),
(2), (4) Date: Apr. 13, 2001

(87) PCT Pub. No.: WO00/21759

PCT Pub. Date: Apr. 20, 2000

(30) Foreign Application Priority Data

Oct. 14, 1998 (AT) ..... 672/98 U

(51) Int. Cl.[7] ..... B41K 1/56
(52) U.S. Cl. ..... 101/405; 101/333; 101/334
(58) Field of Search ..... 101/405, 333, 101/334, 406, 125, 103, 104, 327

(56) References Cited

U.S. PATENT DOCUMENTS 4,532,642 A * 7/1985 Morris et al. ..... 377/15
4,735,143 A * 4/1988 Weir ..... 101/333
4,823,696 A * 4/1989 Skopek ..... 101/334
5,058,501 A 10/1991 Skopek
5,123,349 A * 6/1992 Beaver et al. ..... 101/333
5,727,467 A * 3/1998 Skopek ..... 101/334
5,850,787 A * 12/1998 Pichler ..... 101/105
6,067,905 A * 5/2000 Faber ..... 101/334

FOREIGN PATENT DOCUMENTS

AT 379552 1/1986

* cited by examiner

*Primary Examiner*—Andrew H. Hirshfeld
*Assistant Examiner*—Darius N. Cone
(74) *Attorney, Agent, or Firm*—Collard & Roe, P.C.

(57) ABSTRACT

An axial securing device (19) for an end of a pivot axle (6) of a hand stamp (1) comprising a self-inking device, wherein the pivot axle (6) extends through a character unit (3) accommodated in a stamp housing (2) as well as through guiding slots (12) in side walls (7, 8) of the stamp housing (2), the ends of the pivot axle being held in openings (15) in legs (13, 14) of an actuating bow (5), which actuating bow is movable relative to the stamp housing (2), the axial securing device (19) comprising an annular member (17) capable of being snapped onto the end of the pivot axle (6), which annular member comprises at least one radially inward snap projection (20) for snapping engagementin a peripheral groove (21) adjacent the outer end of the pivot axle (6); to facilitate its manufacture, the annular member (17) is formed to be integral with a bearing sleeve (16) which, with the axial securing device (19) mounted, extends through the actuating bow leg (13) as well as through the longitudinal slot (12) in the side wall (7) of the stamp housing (2).

5 Claims, 2 Drawing Sheets

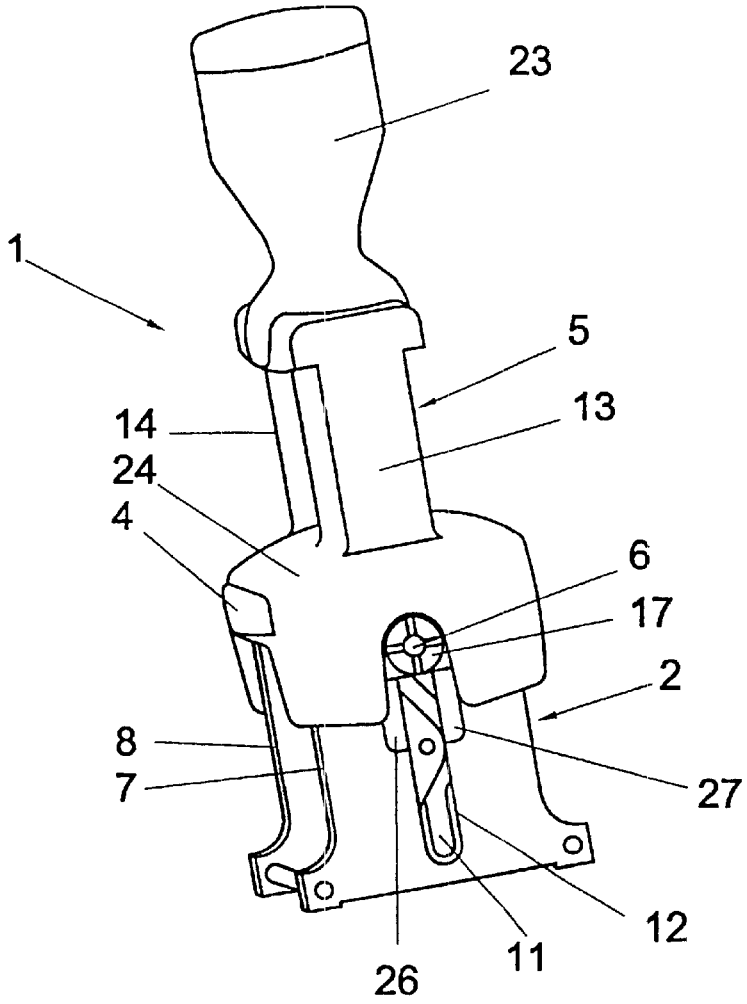
FIG. 1
FIG. 4
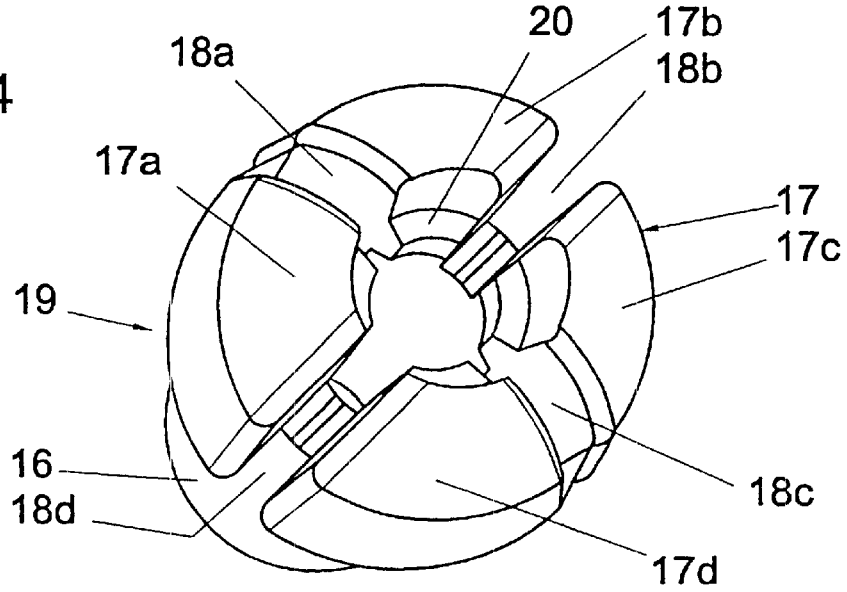

AXIAL LOCKING DEVICE FOR THE SWIVELING AXLE OF A HAND-HELD STAMP AND HAND-HELD STAMP

CROSS REFERENCE TO RELATED APPLICATIONS

Applicant claims priority under 35 U.S.C. §119 of Austrian Application No. GM672/98 filed on Oct. 14, 1998. Applicant also claims priority under 35 U.S.C. §120 of PCT/AT99/00228 filed on Sept. 21, 1999. The international application under PCT article 21(2) was not published in English.

The invention relates to an axial securing device for an end of a pivot axle of a hand stamp comprising a self-inking device, wherein the pivot axle extends through a character unit accommodated in a stamp housing as well as through guiding slots in the side walls of the stamp housing, the ends of the pivot axle being held in openings in legs of an actuating bow, which actuating bow is movable relative to the stamp housing, the axial securing device comprising an annular member capable of being snapped onto the end of the pivot axle, which annular member comprises at least one radially inward snap projection for snapping engagement in a peripheral groove adjacent the outer end of the pivot axis.

Furthermore, the invention relates to a hand stamp comprising at least one such axial securing device.

From U.S. Pat. No. 5,058,501 A, a hand stamp comprising a self-inking device is known, in which a character unit accommodated in a stamp housing is pivoted about a pivot or inverting axle during actuation of the stamp so that it is moved from an inking position, in which the priting characters face upwardly and there contact an inking pad, into an active position in which the printing characters previously inked on the inking pad.

In this known hand stamp, the pivot axle for the character unit is secured on both axle ends by outer Seeger circlip ring-type annular members; these annular members engage in a peripheral groove of the axle by means of radially inwardly projecting latch projections. Within these annular members, bearing rings having a stepped configuration in axial section are provided in both end regions of the pivot axle, said bearing rings being inserted with their smaller diameter regions in the bearing opening of the respective actuating leg, and being engaged in the longitudinal slot-provided in the side walls of the stamp housing for upward and downward movement of the pivot axle. The inner, stepped bearing ring forms a spacer element with its annular flange of larger diameter, so as to maintain the stamp housing and the neighbouring actuating bow leg at a predetermined distance from each other. This axial securing means with the bearing rings as well as with the safety ring member ensures the possibility of a rotational movement of the pivot axle relative to the stamp housing and to the actuating bow, wherein, furthermore, by the rotatability of the bearing rings, little wear of the latter on the stamp housing as well as on the actuating bow is ensured even if these parts are made of metal, as usual, whereas the bearing rings are made of plastics.

A disadvantage with this known solution is, how-ever, that several rings, or annular members, respectively, have to be attached on each axle end, i.e. at different relative positions as regards the remaining components of the hand stamp; this makes mounting of the axle or the assembly of the stamp housing with the actuating bow, respectively, extremely cumbersome and complex. Yet, above all, the attachment of annular members is also disadvantageous with a view to an automatic assembly of the hand stamp, as is desired in principle. Moreover, for merely securing the axle, three individual parts have to be produced and kept on store, which also complicated matters.

From AT 379,552 B, furthermore, a self-inking Stamp comprising upper self-inking means is known, in which retention disks are snapped from outside onto the ends of the pivot axle; in this manner only an axial securing of the pivot axle is realized which the previously discussed disadvantages, mainly with regard to the mounting of the axle, resulting therefrom.

It is now an object of the invention to provide an axial securing device of the initially defined type which facilitates the mounting of the pivot axle or of the assembly of the components of the hand stamp, respectively, and simultaneously ensures a bearing or guiding of the axle in the bearing housing and in the actuating bow, wherein the rotatability and endurance shall also be ensured if such components are made of metal.

The inventive axial securing device of the initially defined type is characterized in that the annular member is formed to be integral with a bearing sleeve which, with the axial securing device mounted, extends through the actuating bow leg as well as through the longitudinal slot in the side wall of the stamp housing.

The invention thus provides an axial securing device with integrated guide means, or integrated bearing part, respectively, in the form of a bearing sleeve which offers the advantage that on the (preferably, on each) axle end of the pivot axle only one structural element must be mounted; it is a further advantage that the axial securing device element can be snapped onto the axle end from the outside when the stamp housing and the actuating bow have already been brought into their respective relative positions so that also the previously mentioned snap-on procedure can be effected in a simple manner, in particular automatically.

For mounting and dismounting of the thus generally nipple-type axial securing element it is particularly advantageous if the annular member is formed by several annular segments projecting from the front end of the bearing sleeve and separated from each other by slots. By the presence of several annular segments separated from each other by slots, a resilient deflection of these annular segments relative to the bearing sleeve from which they project axially as well as radially is comparatively easily possible when they are snapped onto the axle ends just like when they are removed therefrom, as compared to a closed annular form in which snapping on or removal has to be performed by an elastic material deformation of the inner snap projection(s). With a view to a simple manufacture as well as to a favorable configuration for snapping on and removal, it has proven to be a particularly advantageous compromise if four annular segments are provided, each corresponding approximately to a quarter circular arc seen in front end view, separated from each other by slots extending perpendicular relative to each other.

It is also suitable if the annular member and the bearing sleeve together are injection-molded of plastics, such as, e.g., POM (polyoxymethylene). By such a production as an injection-molded part, an especially cost-saving production is ensured. As the materials, in principle also other plastics materials suitable for injection molding may be used, in particular thermo-plastic materials, such as PMA (polymethacrylate), PMMA (polymethyl-methacrylate) or ABS (acrylonitrile-butadiene-styrene).

A further object of the invention is a hand stamp comprising at least one axial securing device according to the invention. There, too, the invention preferably provides for a hand stamp wherein on a guiding part guiding the legs of the actuating bow in a manner known per se and attached on the stamp housing, at least one lug plate is molded which extends as a spacer element into the gap between the stamp housing and the respective actuating bow leg. With this design, a substitute for the annular flanges of the bearing rings serving as spacers of the hand stamp known from U.S. Pat. No. 5,058,501 A is provided by the at least one lug plate on the guiding part which acts as a spacer, so that in the region of this (these) lug plate(s), i.e. in the region of the lower rim of the guiding part, the legs of the actuating bow are held at a pre-determined distance from the outer side of the side walls of the stamp housing. Thus, said lug plate(s) assume(s) the spacer and guiding function for the respective leg of the actuating bow during downward movement of the latter relative to the stamp housing, which functions, at the known stamp, are carried out by the flanges of the separate bearing rings located on the pivot axle, which bearing rings are dispensed with by the configuration of the present axial securing device comprising the bearing sleeve of uniform outer diameter.

The invention will now be described in more detail by way of a particularly preferred exemplary embodiment illustrated in the drawing to which, however, it shall not be restricted. In detail, FIG. 1 shows an elevational view of a hand stamp including a self-inking device;

FIG. 4 is an elevational view of the one-piece axial securing element, as it is apparent from FIGS. 2 and 3.

Figure 3:
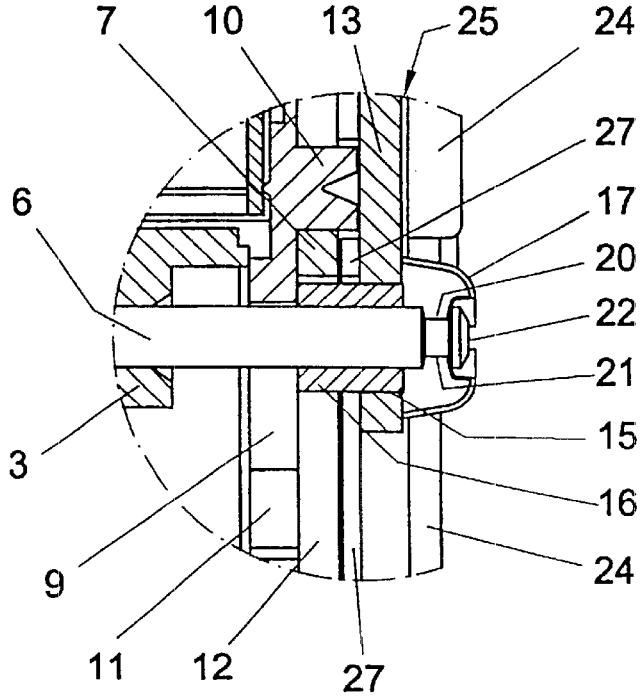
FIG. 3 shows a longitudinal section of this part of the hand stamp, according to line III—III in FIG. 2.

In FIG. 1, a hand stamp having a per se conventional general structure including a self-inking device is illustrated which generally is denoted by 1, and which comprises a stamp housing 2 of metal in which a character unit not visible in FIG. 1 and partially illustrated in FIG. 3 is accommodated. The—fixed and/or variable—printing characters of this character unit 3 face upwardly in the at-rest position illustrated in FIGS. 1 and 3, and in this instance they contact an inking pad, not shown in detail, inserted in an insertion compartment 4; from this at rest position or inking position, the character unit 3 is moved into a lower printing position by aid of an actuating bow 5, and in doing so, it is turned by 180° about a pivot axle or inverting axle 6 by aid of a inverting mechanism. The inverting mechanism for such a stamp comprising upper self-inking means is known per se and need not be further explained; it should only be pointed out that control rockers 9 are pivoted, by aid of a latched bearing projection 10, to the inner sides of side walls 7, 8 of the stamp housing 2 in the upper regions thereof cf. FIG. 3, and these control rockers 9 each comprise a radial cam 11 in the form of an arcuate slot which its penetrated by the pivot axle just as a straight longitudinal slot 12 in the side walls 7, 8 of the stamp housing 2. Furthermore, the pivot axle 6 also penetrates the—usually also metallic—legs 13, 14 of the actuating bow 5 which, seen in side-view, are also generally U-shaped in a manner known per se. In detail, the legs 13, 14 each have a circular bearing opening 15, cf. FIG. 3, and the pivot axle 6 is mounted in this bearing opening 15 by means of a bearing sleeve 16 so as to be rotatable.

The bearing sleeve 16 is of generally cylindrical design and formed in one piece with an external annular element 17 which serves to fix the pivot axle 6. As can best be seen from FIG. 4 in addition to FIGS. 2 and 3, this annular, axle-securing part 17 consists of four annular segments denoted by 17*a* to 17*d* in FIG. 4, each extending according to a quarter circular arc as well as separated from each other in pairs through a slot 18*a*, 18*b*, 18*c* and 18*d*, respectively. As is apparent from FIG. 4 and also from FIG. 2, these slots 18*a* to 18*d* are arranged in cross-shape, extending perpendicular relative to each other, and in axial direction they end at the bearing sleeve 16. On the other hand, this means that the annular segments 17*a* to 17*d* project axially forwardly from the bearing sleeve 16 proper and thus also extend radially outwardly beyond the outer circumference of the bearing sleeve 16, wherein they can perform a resilient deflection relative to the bearing sleeve 16. In this manner, they can be moved radially outwardly when the axially securing "nipple" which as a whole is denoted by 19 in FIG. 4, is slipped onto the respective end of the pivot axle 6. This is necessary because the annular segments 17*a* to 17*d* on their inner sides each are formed with a latching projection 20 which, as is apparent from FIG. 3, latches into a peripheral groove or annular groove 21 adjacent the outer end 22 of the pivot axle 6.

In principle it is, of course, also possible to provide fewer or more annular segments instead of the four annular segments 17*a* to 17*d*, such as two, three, or also six, yet the provision of four annular segments 17*a* to 17*d*, as illustrated, has proven advantageous with a view to as simple a production, on the one hand, and as particularly suitable for a good, reliably snap-on connection, on the other hand. With smaller dimensions of the annular element 17, it is suitable for production purposes to provide fewer—e.g. three—annular segments.

The axle-securing "nipple" 19 preferably is made by injection molding or injection of plastics, in particular a thermoplastic, such as ABS or PMA. POM (polyoxmethylene) is particularly preferred as the material for the axle-securing nipple. These synthetic materials have high strength, and when tested have proven to be advantageous for the instant purpose.

As is further apparent from FIG. 1, the legs 13, 14 of the actuating bow 5 which comprises a handle 23 for actuating purposes, are guided in a guiding part 24 during the downward movement along the stamp housing 2, which guiding part 24 is put onto the upper side of the stamp housing 2 like a cap and which also defines the insertion compartment 4 for the inking pad. This guiding part 24 also is made of plastics, such as POM or ABS, and it has a slot guide for the legs 13, 14 of the actuating bow 5, as is known per se, cf. also slot 25 in FIG. 3.

Figure 2:
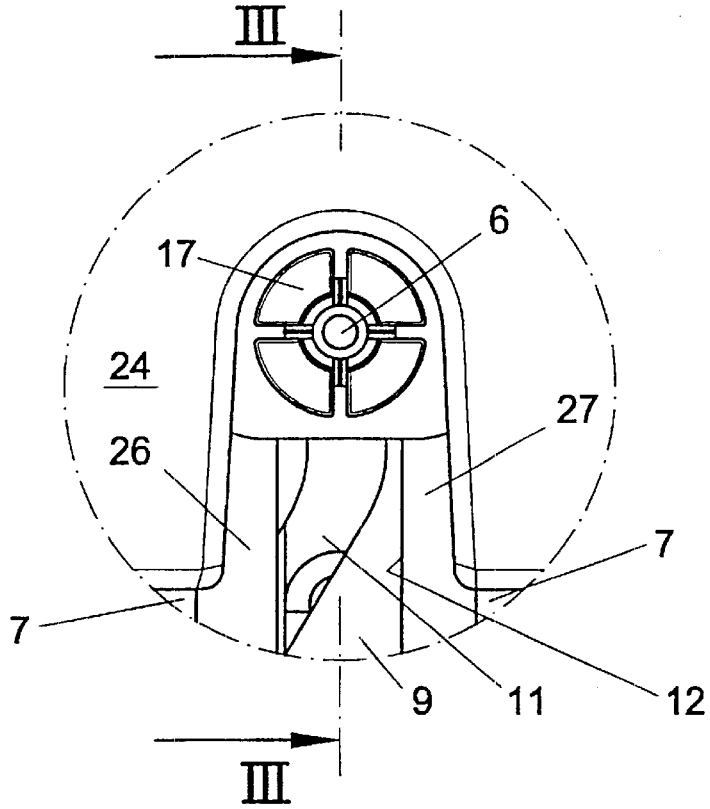
FIG. 2 shows a detailed view of this hand stamp in the region of the axial securing device for the pivot axle of the character unit.

Lug plates 26, 27 are formed in one piece with this guiding part 24, these lug plates abutting on either side, i.e. on the outer sides, of the two side walls 7, 8 of the stamp housing 2, cf. FIGS. 1 and 2, one plate 27 being visible partially also in the sectional representation of FIG. 3. As apparent, these plates 26, 27 are spaced from each other according to the slot width of the longitudinal slot 12 in the respective side wall 7 or 8, respectively, of the stamp housing 2. The plates 26, 27 serve as distance elements, i.e. spacers, during guiding of the legs 13 or 14, respectively, of the actuating bow 5 during its downward movement relative to the stamp housing 2, wherein they keep the legs 13, 14 at a pre-determined distance (in the order of 1 mm) from the side walls 7 and 8, respectively, of the stamp housing 2. In the hand stamp according to U.S. Pat. No. 5,058,501 A, this spacer function was performed by the inner, step-shaped bearing rings provided there as a bearing means, or, more precisely, by their radial flanges which, however, in the present axial securing device 19 with the simple, cylindrical bearing sleeve 16 formed in one piece with the annular element 19, have been omitted because of this design and because this part is mounted by being slipped onto the pivot axle 6 from the outside.

The axial securing device 19 described preferably is provided on both ends of the pivot axle 6, even though it would be conceivable to secure only one end of the axle therewith.

What is claimed is:

1. An axial securing device (19) for an end of a pivot axle (6) of a hand stamp (1) comprising a self-inking device, wherein the pivot axle (6) extends through a character unit (3) accommodated in a stamp housing (2) as well as through guiding slots (12) in the side walls (7, 8) of the stamp housing (2), the ends of the pivot axle being held in openings (15) in legs (13, 14) of an actuating bow (5), which actuating bow is movable relative to the stamp housing (2), the axial securing device (19) comprising an annular member (17) capable of being snapped onto the end of the pivot axle (6), which annular member comprises at least one radially inward snap projection (20) for snapping engagement in a peripheral groove (21) adjacent the outer end of the pivot axle (6), characterized in that the annular member (17) is formed to be integral with a bearing sleeve (16) which, with the axial securing device (19) mounted, extends through the actuating bow leg (13) as well as through the longitudinal slot (12) in the side wall (7) of the stamp housing (2).

2. An axial securing device according to claim 1, characterized in that the annular member (17) is formed by several annular segments (17*a*–17*d*) projecting from the front end of the bearing sleeve (16) and separated from each other by slots (18*a*–18*d*).

3. An axial securing device according to claim 2, characterized in that four annular segments—(—17*a*–17*d*) are provided, each corresponding approximately to a quarter circular arc seen in front end view, separated from each other by slots (18*a*–18*d*) extending perpendicular relative to each other.

4. An axial securing device according to claim 1, characterized in that the annular member (17) and the bearing sleeve (16) together are injection-molded of plastics.

5. A hand stamp (1) comprising at least one axial securing device (19) according to claim 1, characterized in that on a guiding part (24) guiding the legs (13, 14) of the actuating bow (5) and attached on the stamp housing (2), at least one lug plate (26, 27) is molded which extends as a spacer element into the gap between the stamp housing (2) and the respective actuating bow leg (13).

* * * * *